United States Patent [19]

Karmel

[11] Patent Number: 5,061,305

[45] Date of Patent: Oct. 29, 1991

[54] VACUUM FILTER UNIT

[76] Inventor: Israel Karmel, Box 488, Garibaldi Highlands, British Columbia, Canada, V0N 1T0

[21] Appl. No.: 460,393

[22] Filed: Jan. 3, 1990

Related U.S. Application Data

[63] Continuation-in-part of Ser. No. 394,005, Aug. 15, 1989, abandoned, and Ser. No. 108,424, Oct. 14, 1987, abandoned.

[51] Int. Cl.[5] ..... B01D 46/00

[52] U.S. Cl. ..... 55/429; 55/472; 55/476; 55/510; 55/DIG. 3

[58] Field of Search ..... 55/319, 364, 366, 377, 55/378, 425, 429, 472, 476, 508, 510, DIG. 3, DIG. 8

[56] References Cited

U.S. PATENT DOCUMENTS

| | | | |
|---|---|---|---|
| 921,632 | 5/1909 | Smith | 55/472 |
| 948,993 | 2/1910 | Hemmer | 55/376 |
| 951,808 | 3/1910 | Frank | 55/429 |
| 999,604 | 8/1911 | Spencer | 55/429 |
| 1,134,022 | 3/1915 | Spencer | 55/429 |
| 1,403,112 | 1/1922 | Ford | 55/364 |
| 1,455,117 | 5/1923 | McClelland | 55/429 |
| 1,899,993 | 3/1933 | Spencer | 55/476 |
| 2,289,009 | 7/1942 | Glesser et al. | 55/366 |
| 3,023,447 | 3/1962 | Senne | 55/378 |
| 3,260,038 | 7/1966 | Casady | 55/378 |
| 3,995,414 | 12/1976 | Kerr et al. | 55/264 |
| 4,084,948 | 4/1978 | Powell, Jr. | 55/509 |
| 4,326,864 | 4/1982 | Sittler | 55/364 |
| 4,735,639 | 4/1988 | Johnstone | 55/DIG. 3 |
| 4,838,907 | 6/1989 | Perry | 55/366 |

FOREIGN PATENT DOCUMENTS

| | | | |
|---|---|---|---|
| 135278 | 10/1902 | Fed. Rep. of Germany | 55/319 |
| 384462 | 12/1932 | United Kingdom | 55/364 |

*Primary Examiner*—Jay H. Woo
*Assistant Examiner*—C. Scott Bushey
*Attorney, Agent, or Firm*—Christie, Parker & Hale

[57] ABSTRACT

A vacuum filter vessel having a base and a source of vacuum. There is an inlet for dust laden air and a mainly imperforate container to receive dust. The inlet and the source of vacuum communicate with each other by a passageway extending around the container to communicate the top of the container and the vacuum source. There is a perforate filter member at the top of the mainly imperforate container to filter dust from the dust laden air.

7 Claims, 5 Drawing Sheets

VACUUM FILTER UNIT

CROSS-REFERENCE TO RELATED APPLICATION

This application is a continuation-in-part of application Ser. No. 394,005 filed Aug. 15, 1989, now abandoned, the disclosure of which is incorporated herein by reference, and is a continuation-in-part of application Ser. No. 108,424, filed Oct. 14, 1987, now abandoned.

FIELD OF THE INVENTION

This invention relates to a vacuum filter vessel finding particular application in central vacuuming systems and portable cleaners.

DESCRIPTION OF THE PRIOR ART

In a central vacuuming system a building may be vacuum cleaned by a large central vacuum system including one or more motors to drive one or more fans to develop substantial suction. Small hand held hoses with attachments are then moved over the building to provide vacuum cleaning. The dust, trash, sand, dirt and the like (collectively referred to as dust in this specification) is sucked through the hose, through pipes, to a central vacuum vessel where the dust laden air is forced through a filter. Typically the motor in the vacuum vessel is switched on automatically by a switch operated by the insertion of the hose into an outlet in a wall in the building.

In all vacuum systems of this type, as with conventional vacuum cleaners, the dust laden air is drawn through a filter in the form of a completely porous container that, most of the time, already contains dust. That is the motor driven fan, the source of vacuum, is on the side of the porous dust container remote from the inlet for dust laden air to create reduced pressure all around the outside of the porous dust container. The fan thus sucks air all around the outside surface of a completely porous container.

This dramatically reduces the efficiency of the cleaning system as the container fills up and necessitates the fairly frequent emptying of the bag if reasonable efficiency of the system is to be maintained. It also exerts excessive strain on the motor, requiring it to work harder to develop the necessary suction and causing it to run hot.

Further by drawing air through the dust already in the porous container, there is a tendency to suck some of that dust back into the atmosphere of the building. The porous container may not be emptied for several months in many cases, which accentuates the problem.

Thus, at present, there is no system known to applicant that has a motor or motors on the side or at the bottom of the dust-container of a central vacuum vessel that does not use completely porous, replaceable filter bags.

In prior art systems with the motor at the bottom and, to a large extent, those with the motor on the top, when the fan is turning there is a cyclone action that swirls the dust in the container. Nearly all the dust is swirled around the container at high speed and some escapes through the exhaust system back into the building. No known system using a fan at the bottom or side is bagless; most have to use replaceable bags.

SUMMARY OF THE INVENTION

The present invention seeks to provide a system in which the dust laden air is not drawn through a filtering device already filled with dust.

Accordingly, the present invention is in a vacuum filter vessel comprising a source of vacuum, an inlet for dust laden air, a container to receive dust, means communicating the inlet and the source of vacuum and is the improvement comprising the means communicating the inlet and the vacuum source being a passageway extending around the container to communicate the top of the container and the vacuum source.

In a preferred embodiment the vacuum source is, as is conventional, a motor driving a fan in the base of the vessel or on the side. In these circumstances, the inlet is in the top of the vessel.

Unlike prior art systems, the container for dust may be mainly imperforate.

DESCRIPTION OF THE DRAWINGS

Aspects of the invention are illustrated, merely by way of example, in the accompanying drawings in which.

DESCRIPTION OF THE PREFERRED EMBODIMENTS

Figure 1:
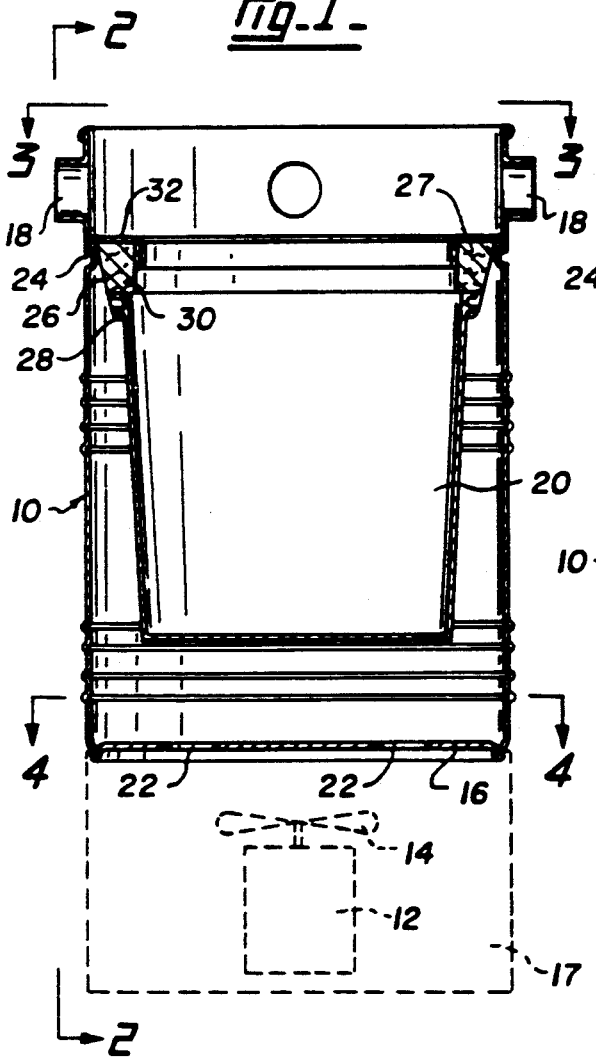
FIG. 1 is a side elevation, partially in section, of a vacuum filter vessel according to the present invention.

The drawings show a vacuum filter vessel 10 including a source of vacuum, schematically shown in FIG. 1 as an electric motor 12 driving a fan 14. A plurality of motors and fans may be used. Partition 16 defines a roof for a compartment 17 for the motor 12.

There is an inlet 18 for dust laden air in the upper part of the vessel 10. Two inlets 18 are shown but only one would usually be connected. There is an imperforate container 20 to receive dust. There are means communicating the inlet 18 and the motor 12. Thus there are openings 22 formed in the partition 16. Furthermore, adjacent its top the vessel 10 is formed with an internal flange 24 and a perforate band 26 is suspended from flange 24. The perforate band 26 may be of a good quality filter material, able to filter dust from the air. Inlet 18 is attached to a conventional pipe (not shown) of a central vacuum system.

At the bottom the perforate band 26 is gathered at 28 and the container 20 is provided with a flange 30 to suspend from the perforate band 26.

There is a generally annular ring 32, on top of the flange 24, to deflect dust into the container 20, away from the perforate band 26. Ring 32 is not essential.

The perforate band 26 is shown inclining inwardly downwardly but it can also be suspended so that it is substantially vertical.

Further although ring 32 is shown as a flat disc it can include a downward flange at the inner circumference. The opening in ring 32 can also be much smaller than shown.

FIG. 1 also shows an additional filter material in the form of a foam annulus 27. Annulus 27 is shown as foam but any filter material is appropriate. A lid for vessel 10 is required but is only shown in FIGS. 10, 11 and 13.

Figure 2:
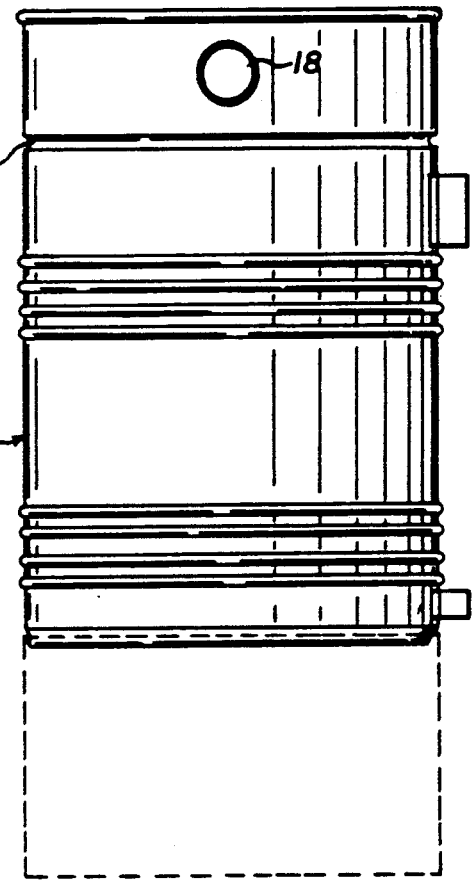
FIG. 2 is a view on the line 2—2 in FIG. 1.
Figure 3:
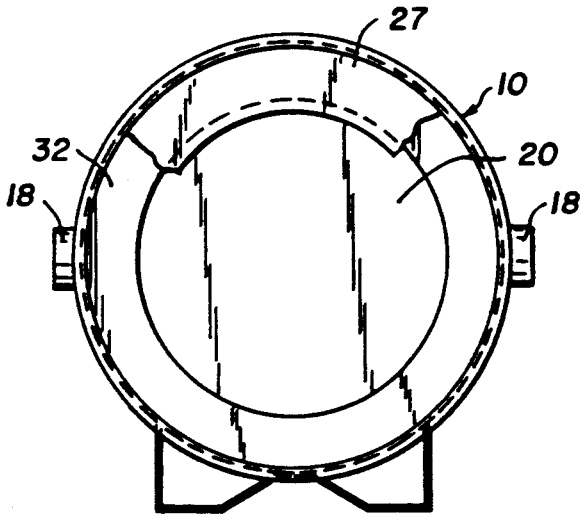
FIG. 3 is a view on the line 3—3 in FIG. 1.
Figure 4:
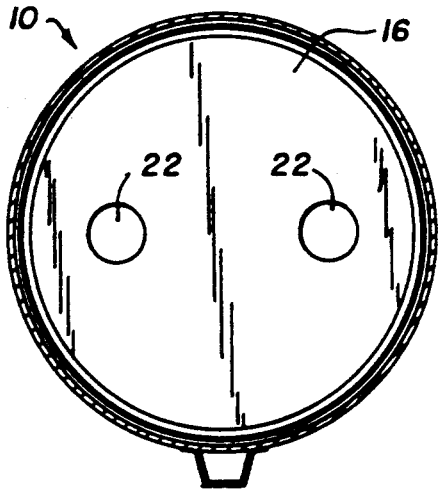
FIG. 4 is a bottom plan view.
Figure 5:
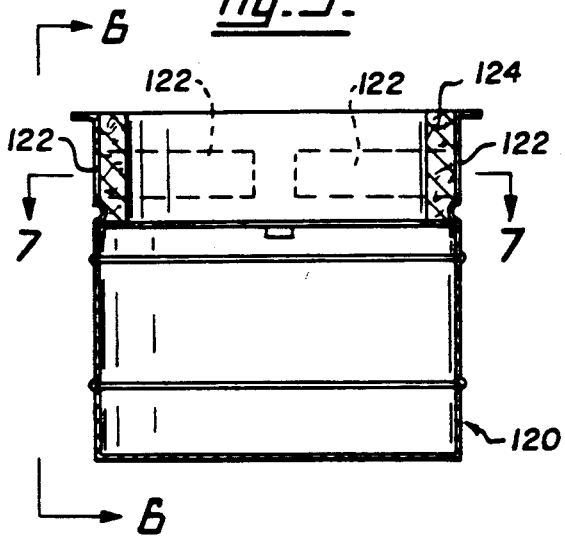
FIG. 5 is a side elevation, partially in section, of a container to receive dust according to a further embodiment of the present invention.
Figure 6:
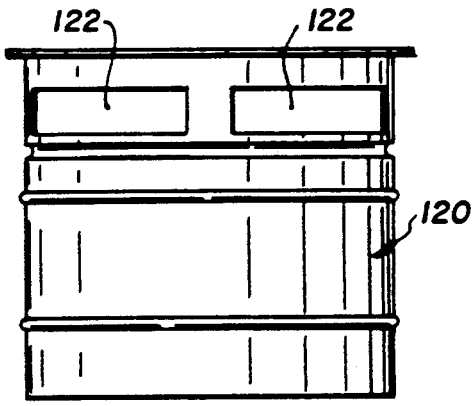
FIG. 6 is a view on the line 6—6 in FIG. 5.
Figure 7:
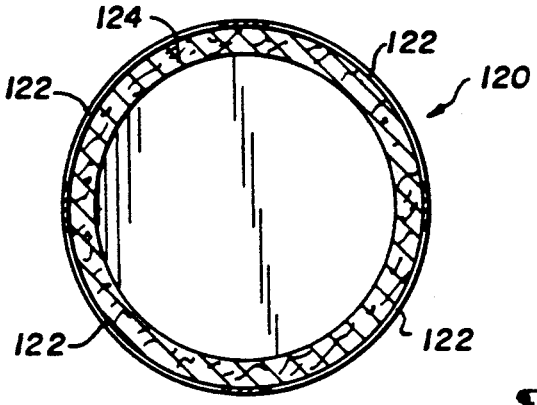
FIG. 7 is a view on the line 7—7 of FIG. 5.

The system in FIGS. 1 and 2 operates as follows. A conventional hand held unit is inserted into an opening in a room to be cleaned. In a conventional manner the insertion of the unit operates a switch to switch on the motor 12 remotely. Air is then drawn through the hand held unit, along a pipe to the vacuum filter vessel 10. The concentration of dust laden air builds up in the filter vessel and the dust is precipitated out of the air and falls down into the imperforate container 20. The passage of dust laden air is through the hand held unit, through the conventional pipe, linking the wall opening with the inlet 18 of vessel 10, through the inlet 18, through the perforate band 26 and disc 27 through the openings 22 to the motor 12. Air is then evacuated from vents in the compartment 17 in conventional manner. Dust is prevented from passing to the motor by the band 26 and the dust is also directed by the ring 32, when present, down into container 20. Dust also drops by gravity, especially when the motor is switched off.

The swirling of dust in the container does not take place in the apparatus of the invention to the same extent.

It will be noted that the dust removal capacity of the equipment remains constant. Air is never drawn through an increasing depth of dust but always through the same system. Band 26 is preferably made of a fabric having a perforate rubber coating or other suitable means. This facilitates removal of the dust. This band can be easily removed, washed and re-inserted, which is not possible with prior art systems.

The embodiment of FIGS. 5 to 8 differs from that of FIGS. 1 to 4 by the provision of a container 120 having openings 122 adjacent its top. A perforate member 124 fits over the openings 122 to prevent dust entering the vacuum source. Member 124 is shown inside container 120 but it can be outside. This is in a manner analogous to the use of the perforate bands 26 and 27 shown in FIGS. 1 to 4. The operation of the device is precisely the same as in the embodiment of FIGS. 1 to 4 and where appropriate, the same reference numerals are used. Container 120 is an imperforate member that may be of metal or plastic.

Figure 8:
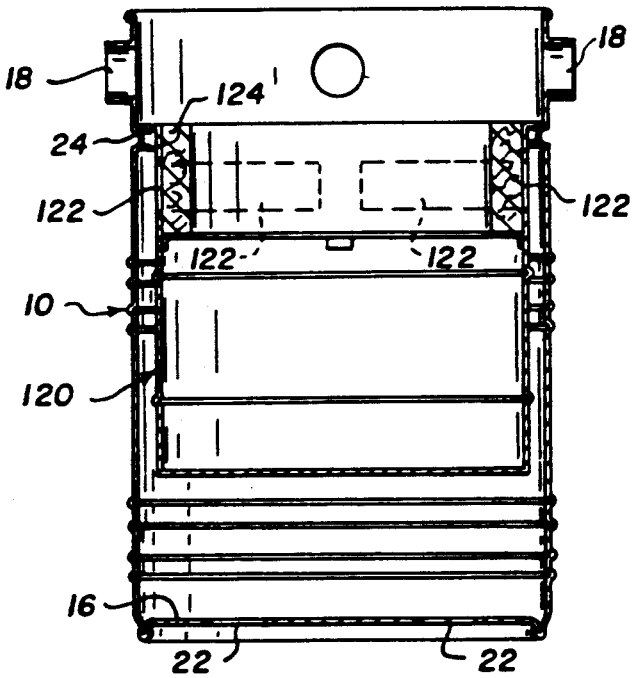
FIG. 8 shows the container of FIG. 5 in position in a vacuum filter vessel.
Figure 9:
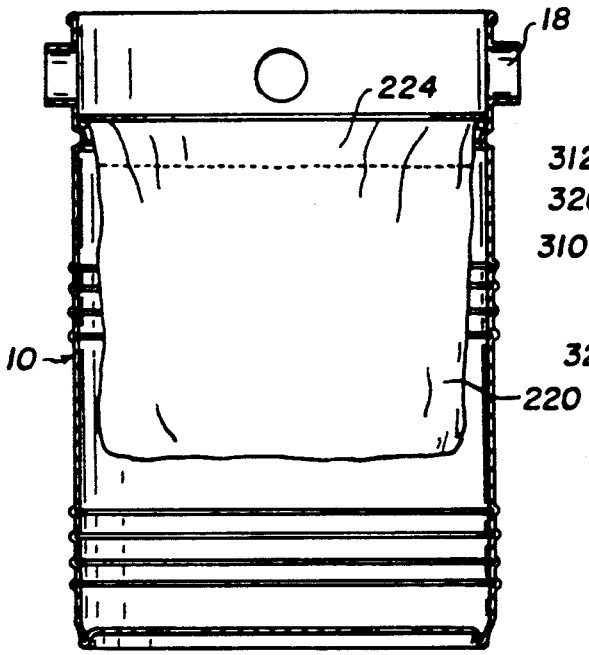
FIG. 9 shows a container according to a further embodiment of the invention.

FIG. 9 shows a variant analogous to the embodiment of FIG. 8 but container 120 and separate perforate member 124 are replaced by a non-porous flexible bag 220 having a perforate strip 224 adjacent its top. Strip 224 may be stitched to container 120 or it may be removably attached by hook and pile as available under the trade mark Velcro.

Figure 10:
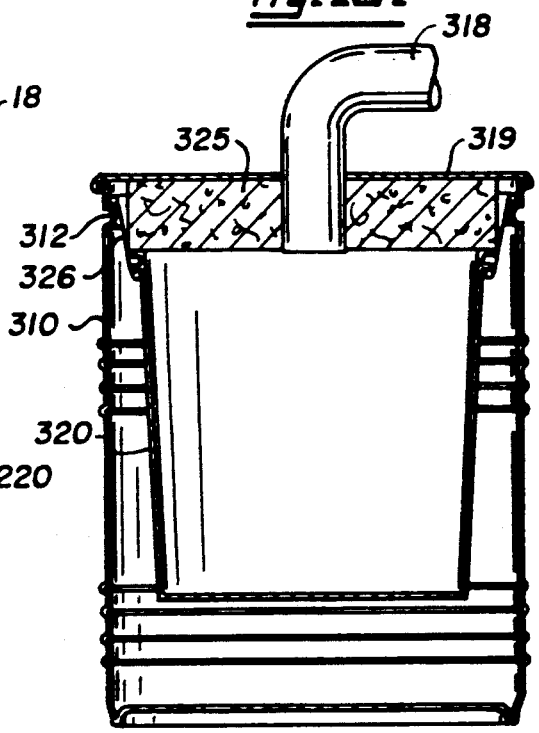
FIG. 10 shows a container of a further embodiment.

FIG. 10 shows a variation in which there is an inlet 318 in a lid 319 of an imperforate container 320 formed with a suspending perforate band 326 in the same manner as discussed in FIG. 1. The vessel 310 has an internal flange 312, as in the embodiment of FIG. 1, which acts to hold band 326 which suspends the container 320. Container 320 supports foam disc filter 325 which is the main filter. Air flow is through inlet 318 into container 320 out laterally through foam disc 325, through perforate band 326. The dust is dropped in container 320. Lid 319 is positioned on the vessel 310. As a variation band 326 can be suspended from the top of the vessel 310 and flange 312 rendered unnecessary.

Figure 11:
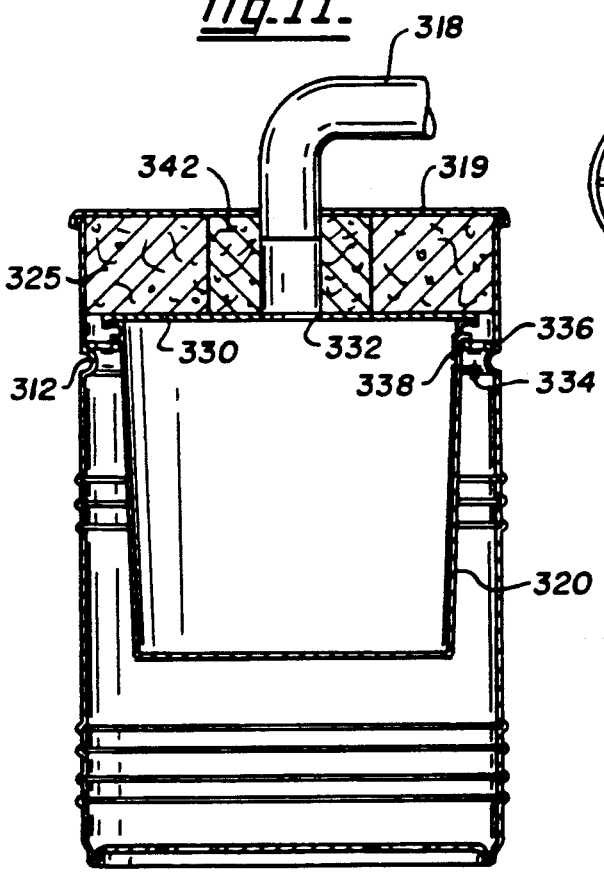
FIG. 11 is a variation of the embodiment of FIG. 10.
Figure 12:
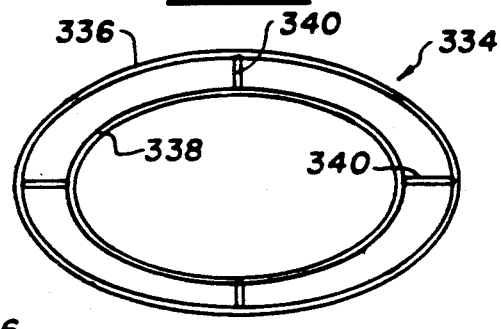
FIG. 12 shows a detail of FIG. 11.

FIG. 11 shows a variation of the FIG. 10 apparatus and the same reference numerals are used in FIG. 11 for the parts that have already been discussed with regard to FIG. 10. However, in FIG. 11 the container 320 has an imperforate lid 330 and perforate band 326 need not be present; foam disc 325 is the only filter. Lid 330 has an opening 332 which aligns with the opening in lid 319 through which pipe 318 passes. Container 320 is supported by a metal annulus 334, shown in FIG. 12, which has an outer ring 336 to sit on flange 312 and an inner ring 338 to carry the container 320. Spacer bars 340 locate the rings 336 and 338.

Lid 319 and container lid 330 act to clamp and locate the filter 325. Air flow differs from FIG. 10. The perforate band 326 is not present in FIG. 11 and the presence of lid 330 means that air flow is only lateral through foam disc 325. A perforate filter cover may be provided on annulus 334 if needed as a back up filter. Filter disc 325 is provided with an inner collar 342 which is a close fit within disc 325. This is present because any dust that tends to container 320 will obviously have to pass through opening 332 and be filtered in the inner part of disc 325. The provision of central collar 342 ensures that probably only this collar may be removed and cleaned to remove most of the dust from the filter as this is the only area that receives suction, which is concentrated on the collar by the presence of lid 330.

Dust laden air is sucked vigorously into container 320, facilitating dropping of the dust and tending to clean the sides of collar 342.

Figure 13:
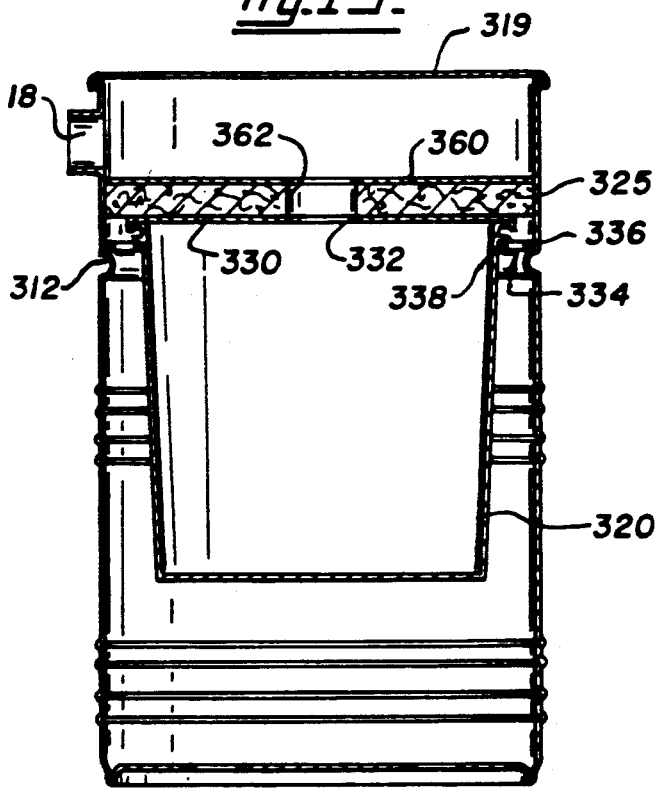
FIG. 13 is a further variation of the embodiment of FIG. 11.

FIG. 13 shows a variation of the FIG. 11 embodiment and, where appropriate, the same reference numerals are used. In FIG. 13 inlet 18 is used and an upper imperforate lid 360, having an opening 362 is used to hold the filter disc 325 between upper lid 360 and imperforate container lid 330. Air flow is as in FIG. 11.

Figure 14:
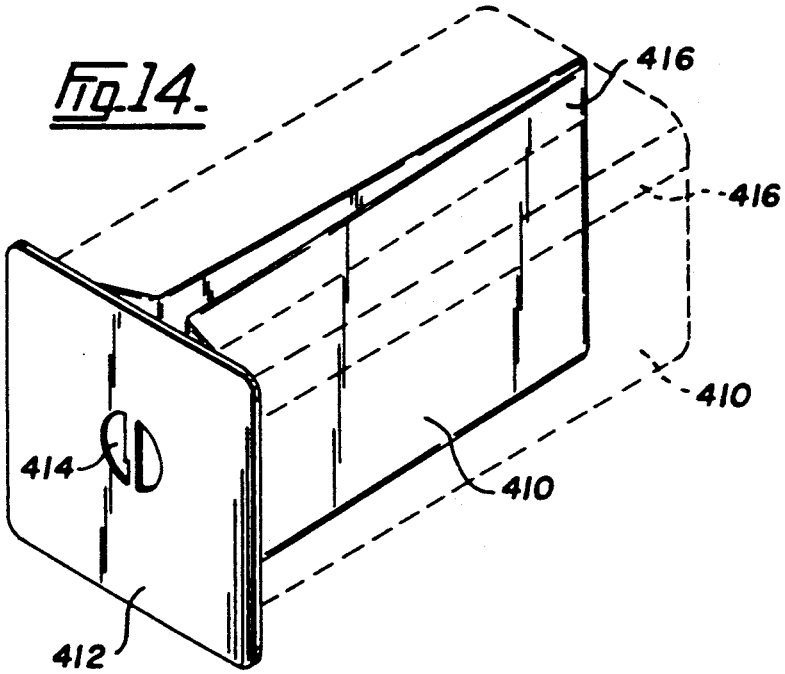
FIG. 14 shows a detail of a further embodiment of the invention.

FIG. 14 shows an embodiment that can be used in a central vacuuming system but also finds application in portable vacuum cleaners. A dust container 410 has a front plate 412 with self-sealing inlet 414. Dust container 410 is imperforate except at its top where it is provided with perforate. area 416. Dust laden air is introduced into inlet 414 through a pipe (not shown) communicating with the hand held unit, that is the cleaning head of the vacuum cleaner.

Dust is dropped into the container 410 and the air rises up through perforate area 416 under the influence of the fan. FIG. 14 shows an open position in broken lines. The containers 410 are conventionally folded for storage but the useful position is the open or expanded position. In a portable vacuum cleaner the container 410 simply replaces the conventional, wholly permeable bag. In for example, the embodiment of FIG. 1, container 410 may replace container 20 and perforate band 26 and inlet 18 would communicate direct with the interior of container 410 through a pipe.

Figure 15:
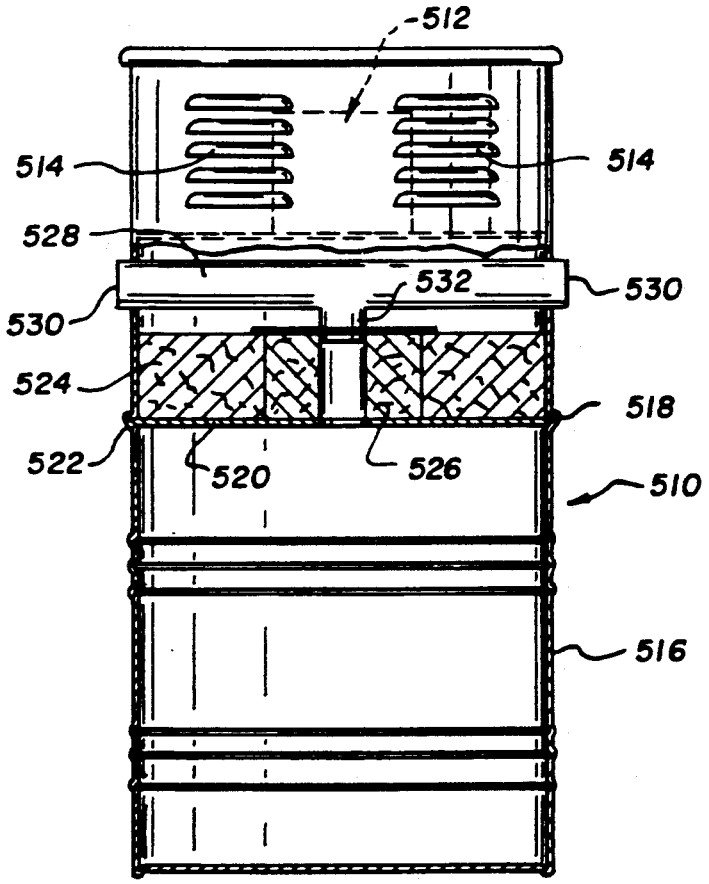
FIG. 15 is a view of a further embodiment of the invention.
Figure 16:
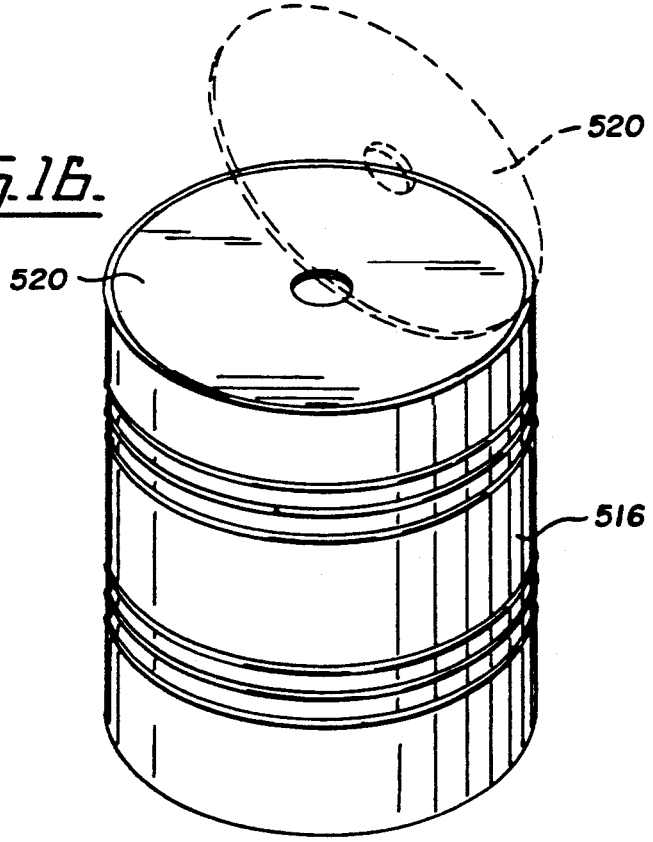
FIG. 16 is a detail of FIG. 15.

FIGS. 15 and 16 show an embodiment of the invention in which, as is known in the art, the source of vacuum—a motor and fan—shown schematically at 512 is located in an upper part 513 of vacuum filter vessel 510. There are vents 514 to allow air flow from the vessel.

There is a lower part 516 to the vessel 510 which is attached, for example by clips, (not shown) at 518. An annular lid 520, shown most clearly in FIG. 16, sits on a ledge 522 within the lower part 516. A filter member in the form of a foam plastic annulus 524 is located on the annular lid 520. An inner annular member 526 is also shown. This member 526 facilitates cleaning. An inlet pipe in the form of a T-piece 528 extends from external connector points 530 to the centre of annulus 526. A small retaining annulus 532 is fitted around the T-piece 528 and sits on the filter members 524 and 526, compressing it to a slight degree against the annular lid 520. Typically the outer ends of the T-piece 528 can be capped when not in use. Generally, speaking one of the inlets will be for vacuuming in the basement or close to the place where the vacuum vessel 510 is located. The other is for attachment to the main system of a house.

It should be noted that filter bags are eliminated in the structure of FIGS. 15 and 16.

To operate the device the motor 512 is switched on in conventional matter and air is forced downwardly through the T-piece 528 where the dust carried by the air is deposited in the lower vessel 516. The air flow is laterally through the filter member 526, then upwardly to be exhausted by the motor 512 through the outlets 514.

The vertical surface of the filter member 526 and the fact that most of the dust is dropped into vessel 516 before it reaches the filter member 526 provide improved performance compared with the prior art equipment. This is because, as explained and described in the operation of FIG. 11, dust-laden air is sucked vigorously into container 516 facilitating dropping of the dust and cleaning the sides of the filter member 526.

The vessel can be emptied with great ease. The clips at 518 are released. The lower vessel 516 is removed and emptied. It is then clipped back in position. The foamed plastic filters 524 and 526 can be cleaned with ease, particularly when the inner annulus 526 is present.

Annulus 532 may be greatly enlarged from that shown in FIG. 15. Annulus 532 may extend close to the wall of vessel 510 but must not contact vessel 510 as it must allow air flow past it. Annulus 532 may be formed integrally with T-piece 528.

Annulus 520 may sit on top of lower part 516 of vessel 510. Ledge 522 is not essential. Annulus 520 may also be wholly within the lower part 516 of vessel 510.

In an important variation lid 520 may be formed integrally with annulus 524, for example by impregnating a lower layer of the annulus 524 with an impermeable resin or by adhering an impermeable annulus of wood, board or metal.

Although described for central vacuum systems the invention can be used with portable systems.

Thus, the present invention shows a vacuum filter vessel offering substantial improvements over the prior art. The characteristic feature of the filter unit of the present invention is that a substantial proportion of dust is precipitated from dust laden air without necessarily encountering the filter. Any filter that is encountered by dust laden air is relatively small in area and located above an imperforate dust container. Dust laden air is drawn to the container, where the majority of dust is deposited. Dust cannot be carried by the air out of the container because of the perforate filter that is always positioned above the dust container in the present invention. The dust container may be flexible or inflexible but is always at least mainly imperforate. Thus, in particular, suction is not applied to the dust laden air to be filtered through a layer of previously accumulated dust.

The present invention, in addition to offering improved performance, offers convenience of use. With the filtering equipment at the top of the apparatus and the fan typically positioned at the bottom or side, the top of the container can be removed and the dust container easily removed and emptied. However, for example, in the embodiment of FIG. 1, the dust receptacle 20 would simply be emptied and replaced in vessel 10 with great ease.

Furthermore, the location of the filters, in the top of the equipment, means that the filter members can be serviced and cleaned with ease. In the preferred embodiments of the present invention there is no bag to replace.

In certain types of prior art vacuum systems the build-up of dirt around the top of the vessel is pronounced. This is particularly so in the so-called cyclone filters. This disadvantage is mainly avoided in the apparatus of the present invention where dust does not build-up at any undesirable area; it merely accumulates in the dust container.

I claim:

1. A vacuum filter vessel comprising:

an upper compartment to receive a source of vacuum;

an inlet pipe for dust-laden air extending into the vessel;

an imperforate container forming a lower compartment of the vacuum filter vessel and removably attached to the remainder of the vacuum filter vessel;

a perforate annular filter adjacent the top of the imperforate container;

an imperforate annulus supporting the perforate annular filter member;

the inlet pipe extending into the top of the annular filter member;

whereby dust-laden air is drawn into the vacuum filter vessel through the inlet pipe to deposit dust into the imperforate container, air being drawn laterally and upwardly through the perforate annular filter so that suction is not applied through dust deposited in the imperforate container.

2. A vessel as claimed in claim 1 in which the inlet pipe for dust-laden air is in a side of the vessel.

3. A vessel as claimed in claim 1 in which the source of vacuum is a motor driving a fan in the upper compartment of the vacuum filter vessel.

4. A vessel as claimed in claim 1 which the perforate annular filter is of a foamed plastic.

5. A vessel as claimed in claim 1 in which the imperforate annulus supporting the perforate annular filter member is an air impermeable layer for the filter member formed integrally on a surface of the annular filter member.

6. A vessel as claimed in claim 1 in which the foam annulus is formed in two parts, an inner and an outer annulus.

7. A vessel as claimed in claim 1 in which the imperforate annulus supporting the perforate annular filter member is separate from the annular filter member and supported at the periphery of the imperforate container.

* * * * *

UNITED STATES PATENT AND TRADEMARK OFFICE

CERTIFICATE OF CORRECTION

PATENT NO. : 5,061,305

DATED : October 29, 1991

INVENTOR(S) : Israel Karmel

It is certified that error appears in the above-identified patent and that said Letters Patent is hereby corrected as shown below:

On Title page, item

[56] References Cited, U.S. PATENT DOCUMENTS

Change "3,995,414 12/1976 Kerr et al...55/264" to -- 3,995,414 12/1976 Kerr et al...55/364 --.

Change "4,084,948 4/1978 Powell, Jr....55/509" to --4,084,948 4/1978 MacFarlane....55/366--.

Insert the following reference:
-- 4,198,726 4/1980 Powell, Jr....55/509 --.

Signed and Sealed this

Thirteenth Day of July, 1993

*Attest:*

*Attesting Officer*

Michael K. Kirk

MICHAEL K. KIRK

*Acting Commissioner of Patents and Trademarks*